US005951454A

United States Patent [19]

Adami

[11] Patent Number: 5,951,454

[45] Date of Patent: Sep. 14, 1999

[54] SYSTEM FOR CREASING AND CUTTING SHEET MATERIAL SUCH AS BOARD OR THE LIKE

[75] Inventor: Mauro Adami, Lucca, Italy

[73] Assignee: Fosber S.p.A., Lucca, Italy

[21] Appl. No.: 08/926,985

[22] Filed: Sep. 10, 1997

Related U.S. Application Data

[63] Continuation of application No. 08/631,172, Apr. 12, 1996.

[30] Foreign Application Priority Data

Apr. 14, 1995 [IT] Italy ..... FI95A0070

[51] Int. Cl.[6] ..... B26F 3/00

[52] U.S. Cl. ..... 493/355

[56] References Cited

U.S. PATENT DOCUMENTS

| | | | |
|---|---|---|---|
| 2,393,586 | 1/1946 | Bruker | 83/479 |
| 3,322,037 | 5/1967 | Cavagnero | 83/100 |
| 3,532,014 | 10/1970 | Franz | 83/53 |
| 4,007,652 | 2/1977 | Sninomiya et al. | 83/177 |
| 4,182,170 | 1/1980 | Grupp . | |
| 5,120,297 | 6/1992 | Adami . | |

FOREIGN PATENT DOCUMENTS

| | | |
|---|---|---|
| 0 458 340 A2 | 5/1991 | European Pat. Off. . |
| 0 468 374 B1 | 7/1991 | European Pat. Off. . |
| 0 534 177 A1 | 9/1992 | European Pat. Off. . |
| A-0 607 084 | 7/1994 | European Pat. Off. . |
| A-0 692 369 | 1/1996 | European Pat. Off. . |
| B-26 56 242 | of 0000 | Germany . |
| A-19 49 583 | 4/1970 | Germany . |

OTHER PUBLICATIONS

Videotape from Jun. 1994 Paris Trade show as produced by Mitsubishi Heavy Industries (Attachement 2).

*Primary Examiner*—David A. Scherbel
*Assistant Examiner*—Anthony Ojini
*Attorney, Agent, or Firm*—Breiner & Breiner

[57] ABSTRACT

A system is described for cutting and creasing an indefinite weblike material (N) comprising: a first set of creasing tools (15); a second set of creasing tools (17); a first set of cutting tools (31); a second set of cutting tools (33); positioning means (27) for positioning cutting and creasing tools; and first auxiliary cutting members (63) for making cuts not parallel with the direction of advance of the weblike material for the trims (R) along the edges of the weblike material when the change of job occurs. The first auxiliary cutting members (63) make a joining cut (4, 6) between the cut lines (1, 3) defining the trims (R) of one job and the cut lines (1', 3') defining the trims (R') of the next job, without severing the trims (R, R') transversely where the change of job occurs.

21 Claims, 5 Drawing Sheets

SYSTEM FOR CREASING AND CUTTING SHEET MATERIAL SUCH AS BOARD OR THE LIKE

This is a continuation of co-pending application Ser. No. 08/631,172 filed on Apr. 12, 1996.

FIELD OF THE INVENTION

The invention relates to a system for creasing and cutting a sheet material of indefinite length, such as corrugated board or other such material.

More specifically, the invention relates to a system of the type comprising at least two sets of creasing tools and at least two sets of cutting tools that form longitudinal cuts and creases along the weblike material, and in which the creasing tools of one set and the cutting tools of one set work in alternation with the creasing and cutting tools of the other set. Such systems also include tool-positioning equipment which, while the tools of a first set are working, places the tools of the second set, which is currently waiting, ready to process the next job.

PRIOR ART

Such systems handle many different jobs in quick succession, each requiring the production of a certain number of sheets of given dimensions, with a certain arrangement of the crease lines, for example in order to make boxes. The system must be capable of changing its setup very fast in order to switch from one job to the next. The various jobs differ both as regards the size of the sheets to be cut, and as regards the arrangement of the crease lines.

The presence of two sets of creasing and cutting tools makes it possible, by means of suitable robots, to position the tools while they are waiting to process the next job.

In some of these systems, when one job has been finished, the web of board or the like is completely cut off transversely to allow the sets of tools to be swapped over. One such system is described, for example, in U.S. Pat. No. 5,120,297. The transverse cut is performed by an auxiliary cutter located upstream of the creasing and cutting tools. The tail formed by cutting the weblike material off is accelerated so as to create a gap between the tail of the web of the old job and the head of the web of the new job. The cutting and creasing unit rotates within the resulting gap so as to swap the tools working on the previous job with those waiting to begin.

Such a system has the advantages of moderate cost and a limited longitudinal space requirement. However, it does have the disadvantage that the weblike material has to be completely severed transversely. This transverse severing creates a number of problems. In the first place, the tail produced by the transverse cut may wander, with the consequent risk of variations in the tolerance of the cut and out-of-true cutting.

In addition, a trim is always formed along each edge of the weblike material and must be sucked into a suction funnel and eliminated. The creation of a transverse interruption in the web necessitates reinserting the trim into the funnel every time a change of job occurs. Furthermore, lateral wandering of the tail may increase the dimension of the trim and cause it to jam in the suction funnel.

The severing of the weblike material may also cause jamming of the sheets of the second job, that is sheets produced downstream of the transverse cut.

The problems discussed above occur both in systems operating on one level and also in systems operating on a number of levels, i.e. those systems in which a single weblike material of great width is cut lengthwise into two or more strips which are then diverted onto two or more different levels to be made into sheets of different dimensions.

In order to eliminate the problems produced by severing the weblike material transversely between two successive jobs, systems have been devised in which the change of job does not require the web to be transversely severed. Examples of systems which execute the change of job without severing of the weblike material are described, for example, in EP-A-0 458 340, EP-A-0 468 374 and EP-A-0 534 177. In these systems the various creasing and cutting tools of the various sets are located one after the other along the path of the weblike material.

FIGS. 1 through 3 schematically illustrate the arrangement of the cuts executed on a weblike material in accordance with different methods used hitherto in order to carry out the change of job without severing the weblike material transversely. In FIG. 1, three longitudinal cut lines 1, 2 and 3 are made in the first part of weblike material N. The lines 1 and 3 divide the two edge trims R from the middle portion of the weblike material, while the intermediate cut line 2 divides the weblike material into two strips N1 and N2 of different widths. The two strips N1 and N2 can in turn be cut and creased along cut and crease lines (which are not shown) and are fed to two different levels for transverse cutting. When the job is changed, the cut and crease lines change position. The lines 1, 2 and 3 move to positions 1', 2' and 3', and two trims R' of different widths to the trims R are defined. The lines 1, 1' and 3, 3' are intersected by two partial transverse incisions 5 which sever the trims R and define the front edges of the trims R'. The cut lines 2 and 2' partly overlap in a transverse direction to give continuity between the strips N1, N2 and the strips N1' and N2'.

During operation, when the change of job is to be carried out, the auxiliary cutter located upstream of the cutting and creasing unit makes the transverse incisions 5 on the weblike material before the longitudinal cut lines 1, 2, 3, 1', 2', 3' are made by the cutting tools of the cutting and creasing unit.

If the two old strips N1 and N2 and the new strips N1' and N2' are to be conveyed onto two different levels, the change of job carried out as illustrated in FIG. 1 involves a risk that the weblike material N may tear in the intermediate region between the cut lines 2 and 2'. In order to avoid this problem it has been suggested (EP-A-0 458 340) that intermediate transverse incisions be made that would intersect the two longitudinal cut lines. FIG. 2 shows a solution of this kind, in which equivalent items are identified by the same reference numerals as used in FIG. 1. Prior to the longitudinal cut made by the cutting and creasing unit, the auxiliary cutter also makes, in addition to the transverse incisions 5, an intermediate transverse incision 7 positioned so as to be intersected later by the cut lines 2, 2' made by the cutting and creasing unit.

In a still further improved form (see FIG. 3), the transverse incision lines of the trims are made twice, while the intermediate transverse incision line 7 is oblique rather than perpendicular to the direction of advance of the weblike material.

In all the conventional forms, illustrated in FIGS. 1 through 3, the edge trims R and R' have to be severed at the point where the change of job occurs. Consequently they do not solve the problem of the fact that the cut trim may have difficulty entering the suction funnel.

Moreover, in the version shown in FIG. 3, points or whiskers of weblike material are produced at the intermediate transverse incision 7 because of the intersection between the longitudinal cut lines and the intermediate transverse incision 7. This is due to the fact that the transverse incision 7 is made by the auxiliary cutter prior to the making of the longitudinal cuts 1, 2, 3 and 1', 2', 3'. Because the auxiliary cutter that makes the transverse incisions 3, 7 is fixed with respect to the floor, whereas the cutting and creasing unit can move transversely in order to follow the weblike material in case it wanders, it will be obvious that the transverse incision lines 3 and 7 must be longer than theoretically necessary in order to ensure that in each case (even if the weblike material N wanders), the longitudinal cut lines intersect it. The effect is to create points or whiskers of material which can cause the weblike material to jam further downstream.

OBJECTS OF THE INVENTION

It is an object of the present invention to provide a system for cutting and creasing a weblike material, and to provide a corresponding method of cutting and creasing, in which the material does not have to be severed at the change of job, and in which the problems typical of conventional systems are avoided.

In particular, a first object of the present invention is to provide a system which circumvents the problem of the jamming of the trim when the change of job occurs.

Another object of the present invention, in a preferred embodiment, is to provide a system that works on two levels with no risk of jamming.

Another object of the present invention is to provide a system of the type discussed, in which the operation of startup at the beginning of the cycle is facilitated.

Yet another object of the present invention is to provide a very reliable system requiring little maintenance, especially as regards the parts intended to perform the transverse joining incisions where the change of job occurs.

It is also an object of the present invention to provide a system with low power consumption and a low noise level.

SUMMARY OF THE INVENTION

These and other objects and advantages, which will be clear to those skilled in the art from a perusal of the following text, are achieved with a system in which, in addition to the cutting tools formed normally by rotating knives, for the production of longitudinal cut lines auxiliary cutting members are provided which make a joining cut between the cut lines defining the trims of one job and the cut lines defining the trims of the next job, without severing the trims where the change of job occurs. In this way the two edge trims are not severed at the change of job and always remain in their respective suction funnels. This eliminates all the problems that occur with conventional systems caused by the interruption to the trim.

If the system is the dual-level type, second auxiliary cutting members can be provided to make a joining cut between two successive longitudinal cut lines that divide the weblike material into two strips conveyed onto the two different levels. Both the first and second auxiliary cutting members may advantageously be located downstream of the cutting tools, between the latter and the trim suction funnels, and are preferably mounted on the frame that supports the cutting and creasing tools. In this way the auxiliary cutting members can be made to follow any transverse movements of the cutting and creasing tools in order to follow the lateral wander of the weblike material. A perfect join is thus obtained between longitudinal cut lines of two successive jobs even if the weblike material wanders, with no variation in the tolerances.

The auxiliary cutting members may be any type of cutting device capable of executing an oblique, and preferably curved, line across the weblike material in order to make a good join between longitudinal cut lines that are not lined up with each other in the direction of advance of the weblike material. Small-diameter milling cutters, laser systems or water-based cutting systems can be used for this purpose. The last-mentioned are preferred at present.

Pressurized-water nozzles are already used in the field of board cutting, but are often used for the entire longitudinal cut and not just for the join between longitudinal cuts of two successive jobs. This type of system is characterized by high noise levels and high power consumption. Some systems use water cutting nozzles for the auxiliary cutter, that is to say upstream of the cutting and creasing unit, in which case, because the auxiliary cutter is also used to cut transversely right across the weblike material, for example at the beginning of a cycle or in an emergency, high power must be provided in order that the nozzles can also operate when cutting the weblike material transversely right across.

In contrast to this, the present invention uses the water cutting nozzles only to join together the longitudinal cut lines where the change of job occurs. As will be explained below with reference to the detailed description of one embodiment, this allows the installed power necessary to drive the nozzles to be reduced. It also means that a conventional type of auxiliary cutter can be used upstream of the cutting and creasing unit. This auxiliary cutter can be used as an alternative to the auxiliary cutting means in order to create a gap for the change of job, in emergencies. The reliability of the system is accordingly enhanced.

In one highly advantageous embodiment of the invention, the system comprises suction nozzles for sucking in the trims, these nozzles being adjustable transversely with respect to the direction of advance of the weblike material, and the auxiliary cutting members are movable transversely together with said suction nozzles. In this way a single actuator adjusts the position of the suction nozzles and of the auxiliary cutting members that make the connection between the trims of two successive jobs. Moreover, when using water cutting nozzles the pressure of the water directs the trim towards the nozzle, thus ensuring that it is correctly directed towards the shredder.

Further advantageous characteristics of the system and method according to the present invention are described below and indicated in the accompanying claims.

BRIEF DESCRIPTION OF THE DRAWINGS

A clearer understanding of the invention will be derived from the description and attached drawing, which shows a practical and non-restrictive embodiment of the invention. In the drawing.

DETAILED DESCRIPTION OF AN EMBODIMENT

Figure 4:
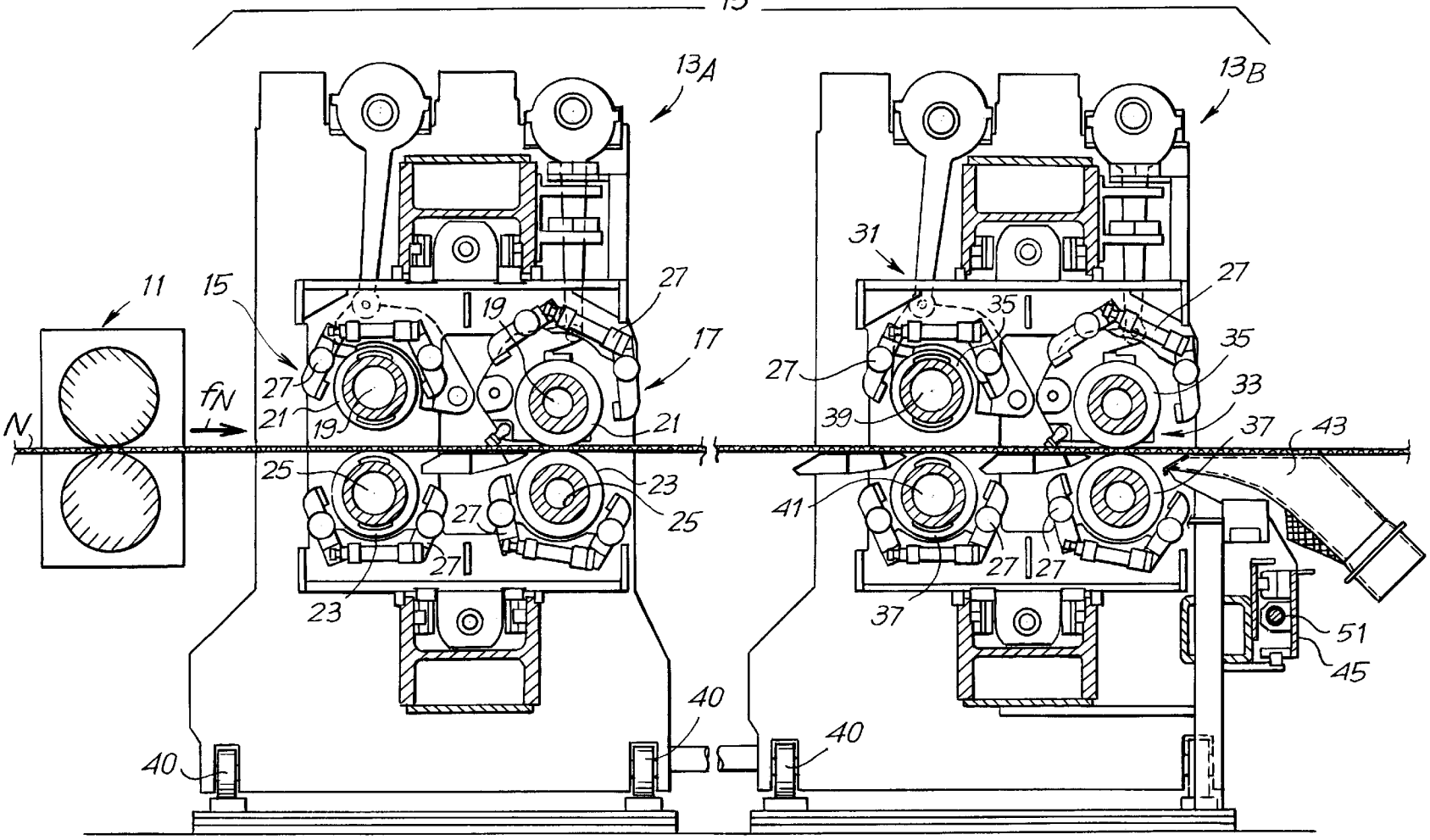
FIG. 4 shows a schematic lateral view of a system according to the present invention.

Referring initially to FIG. 4 (from which the auxiliary cutting members are omitted) the system will be described in general. It comprises an auxiliary cutter 11 used for cutting the front edge of the weblike material N at the beginning of the process, or in emergencies when the weblike material has to be severed. Downstream of the auxiliary cutter 11, with reference to the direction fN of advance of the weblike material N, is the cutting and creasing unit bearing the general reference 13 and comprising a creasing section 13A and a cutting section 13B. The creasing section 13A is located upstream of the cutting section 13B and comprises a first set of creasing tools 15 and a second set of creasing tools 17 in series. The two sets of creasing tools 15 and 17 are essentially symmetrical and therefore only set 15 will be described. This has a first cylinder 19 carrying a series of creasing disks 21 arranged in the position of the crease lines required for the particular job currently being processed. The creasing disks 21 act in combination with mating disks 23 carried by a second cylinder 25.

As is clearly visible in FIG. 4, the creasing cylinders 19 and 25 of the set of creasing tools 17 are arranged in such a position as to cause the creasing tools 21, 23 to act in combination with each other, while the corresponding creasing cylinders of the set of tools 15 are held apart, so that their tools do not touch the weblike material N. In this setup, the positions of the upper and lower creasing tools can be modified with the aid of suitable positioning means 27. The positioning means 27 arrange the creasing tools of the second set in the correct positions for the job which will be coming into production after the current job.

The cutting section 13B is similarly configured. A first set of cutting tools is marked 31 and a second set of cutting tools is marked 33. The set 33 is working, while the set 31 is in the disengaged position to allow the tools to be positioned with the aid of positioning means, which once again are marked 27. In the example illustrated the cutting tools take the form of pairs of knives 35, 37 carried by cutting cylinders 39, 41 respectively. Other cutting tools comprising a disk blade running in a mating blade consisting of a stationary channel or grooved cylinder, can also be used.

Downstream of the cutting section 13B are suction funnels 43 integral with the cutting section: these suck in the edge trims generated by the two outermost cutting tools.

The two cutting and creasing sections are integral with each other and can move sideways on wheels 40 in order to follow the weblike material N in case it wanders, so that the cut lines and crease lines always stay in the correct position with respect to the lateral edges of the weblike material.

Figure 5:
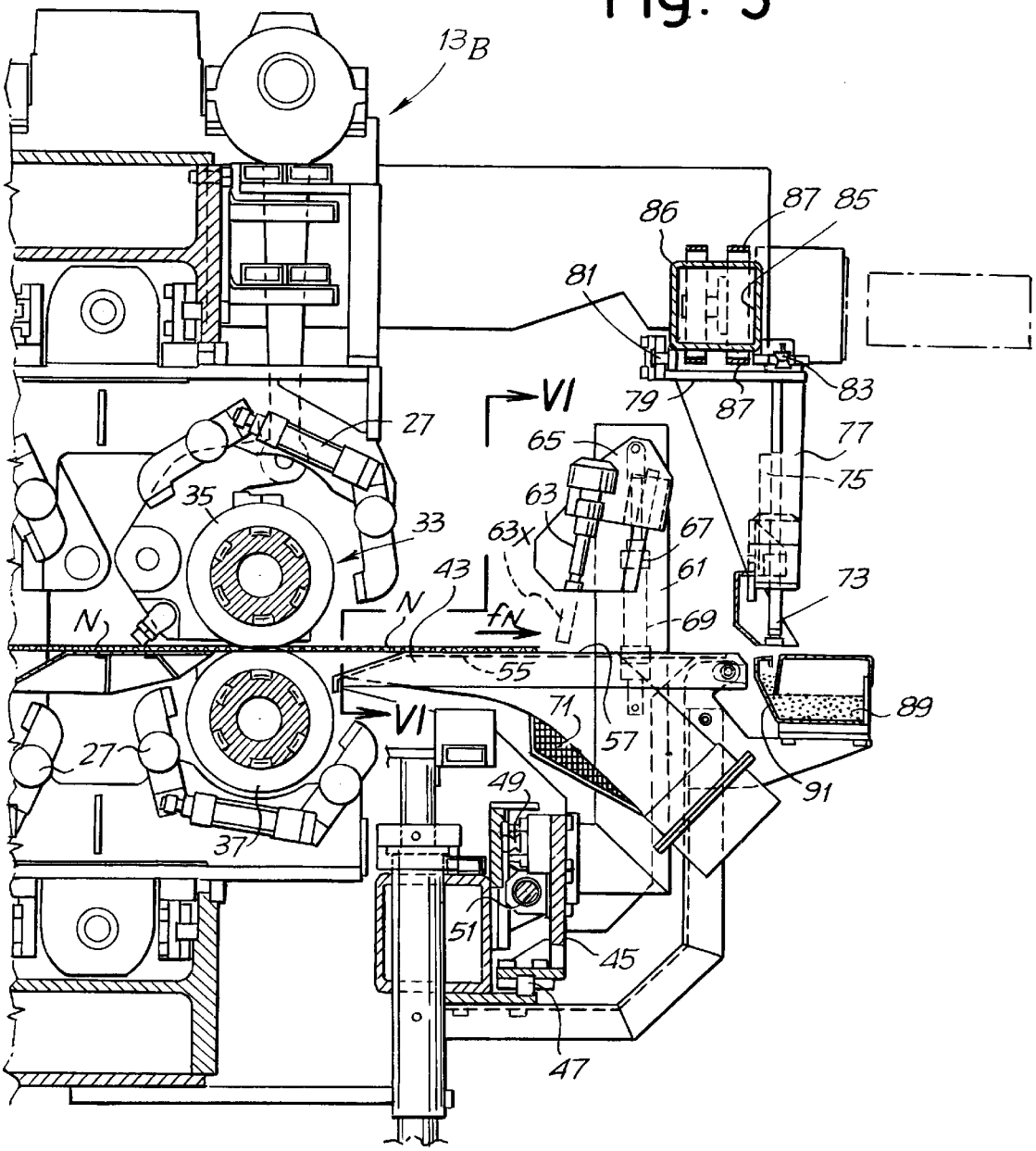
FIG. 5 shows an enlargement of FIG. 4, indicating the auxiliary cutting members.
Figure 6:
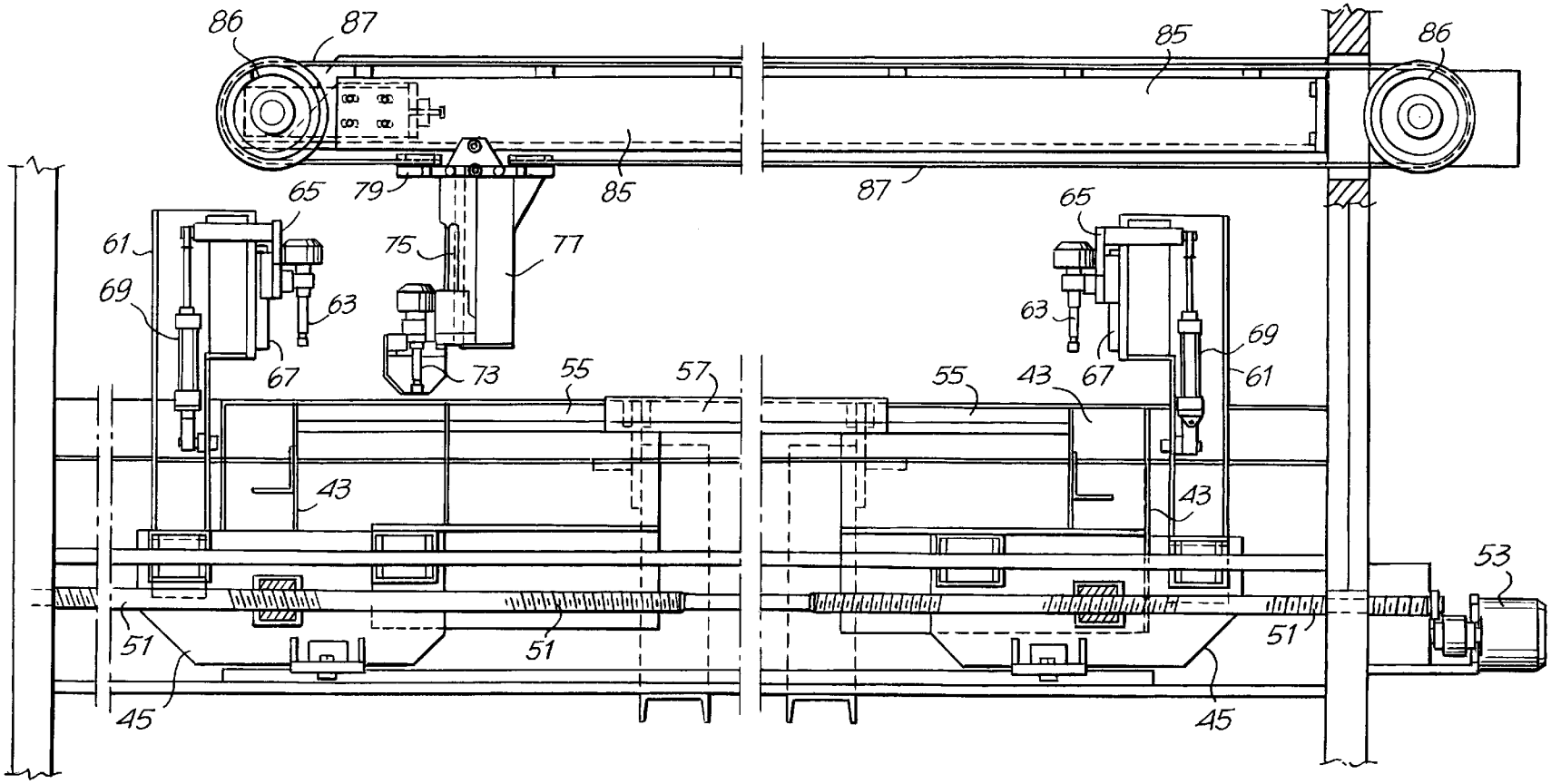
FIG. 6 shows an enlarged view on VI—VI as marked in FIG. 5.

The auxiliary cutting members that join up the longitudinal cut lines when the change of job occurs are depicted in detail in FIGS. 5 and 6.

Each suction funnel 43 is carried by a carriage 45 that moves on two tracks 47, 49 (FIG. 5) which are fixed to the structure of the cutting section 13B of the cutting and creasing unit 13. The two suction funnels 43 are moved away from or toward each other, causing them to adopt a symmetrical position with respect to the center line of the weblike material N, by means of a screwthreaded bar 51 comprising two portions of opposite-handed threads, so that as the bar 51 is rotated by an actuator 53, it moves the suction funnels 43 simultaneously and symmetrically.

Each suction funnel 43 has a guide plate 55 which, together with an additional fixed guide plate 57, forms a surface for the weblike material N to run over. The plates 55, 57 are so arranged that the running surface can be lengthened telescopically in the transverse direction to suit the width of the weblike material N.

Mounted on each carriage 45 is a column 61 bearing a respective water nozzle 63 which makes a joining cut, when the change of job occurs, between the two consecutive longitudinal cut lines defining the edge trim on that particular side. The nozzle is mounted on a slide 65 that travels along an approximately vertical track 67. Its movement is controlled by a cylinder-and-piston actuator 69. In FIGS. 5 and 6 the nozzle 63 is shown in its rest position a short distance away from the weblike material.

When the change of job is to be carried out, the set of cutting tools of the cutting and creasing unit which are currently working are moved into the non-working position, and vice versa. Consequently the longitudinal cut lines of the first job, especially the two cut lines defining the edge trims R, are interrupted when the first job has been finished and resumed, in a different position, for the second job. During this job change-over stage, the nozzles 63 are lowered into position 63X (FIG. 5) and emit a high-pressure jet of water (typically 3400 bar). Their transverse positions coincide initially with the positions of the respective longitudinal cut lines of the first job, and are moved transversely until they reach the transverse positions of the longitudinal lines of the next job. This movement is brought about by the actuator 53 which moves the nozzles 63 and the funnels 43 simultaneously. At the end of the cut, the nozzles 63 are in line with the longitudinal cut lines defining the trims of the new job and are raised until the next cutting operation when the next change of job occurs.

The high-speed jet of water emerging from each nozzle 63 extinguishes its kinetic energy in a corresponding mass of chip material 71 contained in a pocket inside the respective suction funnel 43.

Another water nozzle, marked 73 and situated in an intermediate position, is provided for joining up two successive longitudinal cut lines, at the point where a change of job occurs, that divide the weblike material N into two strips N1 and N2 which will then be conveyed onto two levels. The intermediate nozzle 73 travels along a vertical track 75 mounted on a support 77. In normal conditions the intermediate nozzle 73 is in the lower position, indicated in FIG. 5. It can move up freely in an emergency if the weblike material N bulges up and pushes the nozzle up.

The support 77 is carried by a carriage 79 that travels along two transverse tracks 81, 83 which extend along a cross member 85 that runs across the width of the system. Movement along the cross member 85 is brought about by a belt 87 passing around two pulleys 86 (FIG. 6) and attached at one point to the carriage 79. During the change of job the intermediate nozzle 73 moves sideways from being in line with the longitudinal cut line of the first job, which divides the weblike material into the two strips N1, N2, until it is in line with the longitudinal cut line of the second job.

The kinetic energy of the jet of water from the nozzle 73 is absorbed by a mass of chip material 89 contained in a seat 91 extending transversely.

Figure 7:
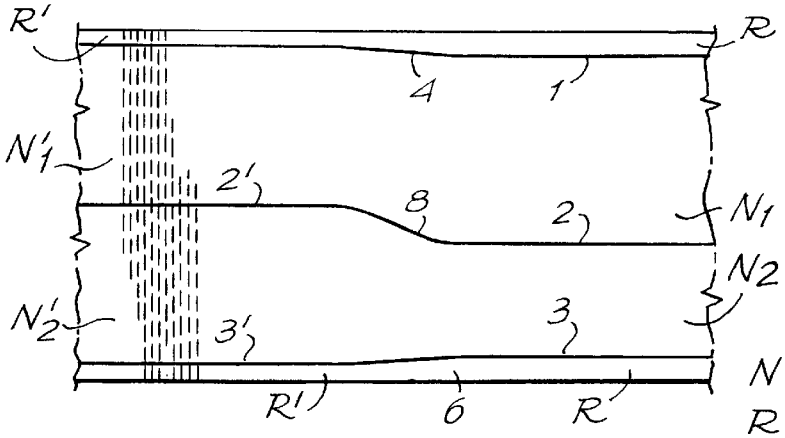
FIG. 7 shows the arrangement of the cut lines produced by the system and method of the present invention.

FIG. 7 shows the arrangement of the cut lines in the weblike material N at the point where the change of job has occurred. The same reference numerals are used as in FIG. 3. As can be seen in FIG. 7, the two longitudinal cut lines 1 and 1' defining one of the trims R, R' are joined up at the point where the change of job occurs by a curvilinear cut 4 made by one of the nozzles 63. Likewise, the longitudinal cut lines 3, 3' are joined up by a curvilinear cut 6 made by the other of the two nozzles 63. The cut lines 2, 2' (which divide the two strips N1, N2 and N1', N2') are joined up by a curvilinear cut 8 made by the intermediate nozzle 73. FIG. 7 shows clearly that the trims R are continuous even where the change of job occurs. Moreover, no lumps or whiskers of weblike material are formed in the region of separation of the two strips N1, N2 and N1', N2' respectively and instead there is a perfect join between the cut lines 2 and 2'.

It will be obvious that more than one intermediate nozzle 73 can be provided, for example two nozzles 73 if the system is built to operate on three levels. In this case one strip of weblike material N will be made into three separate narrower strips.

Figure 3:
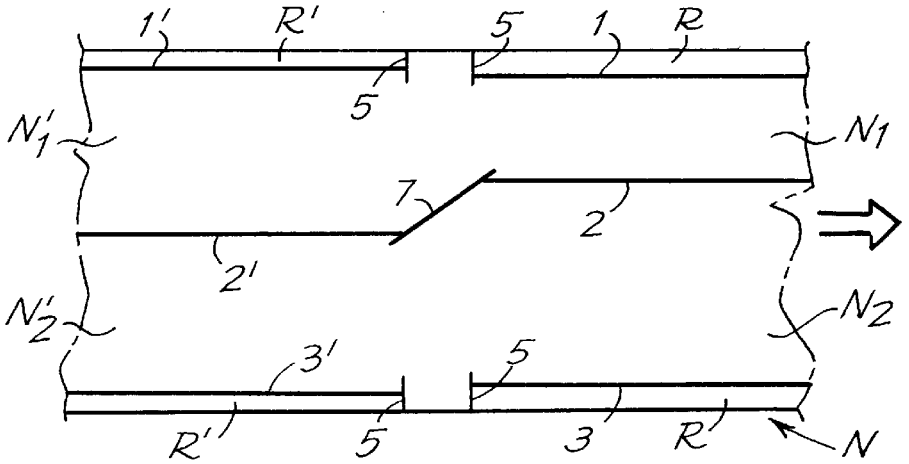

The arrangement of nozzles described above has other major advantages over conventional systems. Thus, all the nozzles 63, 63, 73 are moved into line with their respective cut lines 1, 2, 3 at the end of the previous change of job and are then already in the correct transverse position for the moment when they have to be brought into operation. This means that the nozzles can be activated before the respective longitudinal lines are interrupted, because in each case the jet of water will act on the cut already made by the cutting tools of the cutting and creasing unit. By this means, delays in activating the nozzles, and consequent faulty cutting of the weblike material at the change of job, are avoided. A perfect join is moreover obtained between the consecutive longitudinal lines (1, 1'; 2, 2'; 3, 3'), without the need for fierce transverse acceleration of the nozzles, as occurs for example in conventional systems where the change of job is accomplished as illustrated in FIG. 3, in which the intermediate cut 7 is produced by a nozzle that has been accelerated in the transverse direction before beginning to produce the cut itself.

Figure 8A:
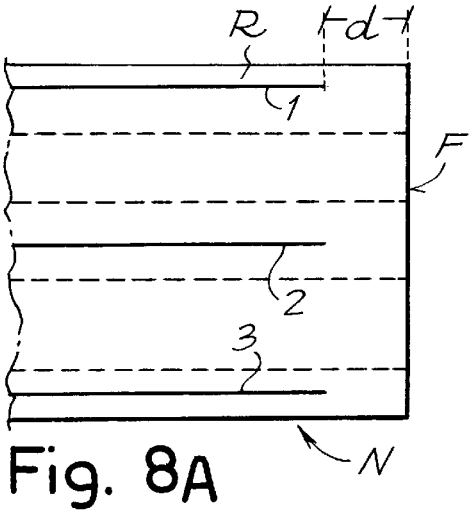
FIGS. 8A and 8B show an arrangement of the cut lines at the beginning of the process cycle.
Figure 8B:
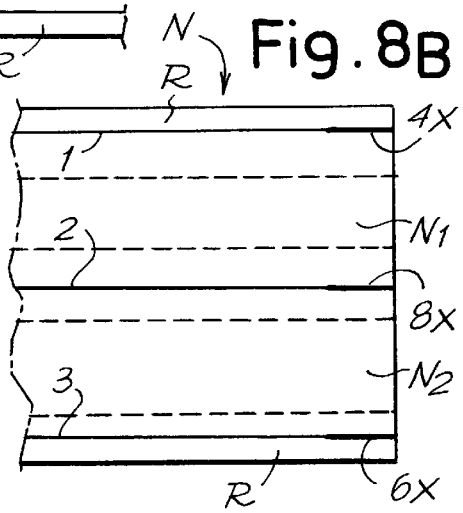

FIGS. 8A and 8B illustrate the initial stages of the process, i.e. starting the system up. The weblike material N is cut across by the auxiliary cutter 11 to give a front edge F. This front edge is fed towards the cutting and creasing unit 13. The cutting tools of one of the sets of tools in section 13B of the cutting and creasing unit are moved into the working position to start the longitudinal cutting of the lines 1, 2, 3 at a certain distance d from the front edge F. Consequently the free front edge F of the weblike material is still whole as it leaves the cutting tools and can easily be guided on its path towards the suction funnels 43. Here the nozzles 63 make two joining cuts 4X, 6X to complete the longitudinal cutting of the weblike material N and feed into each suction funnel 43 the respective trim R, which will not now come out of the funnel until the next time the process is interrupted. In the same way the nozzle 73 will make a cut 8X to separate the weblike material N into the two strips N1, N2.

FIGS. 8A and 8B also indicate longitudinal crease lines in dashes.

The use of the auxiliary cutting members 63, 73 located downstream of the cutting tools of the cutting and creasing unit thus enables the front edge F of the weblike material N to be guided accurately and reliably even at the start of the production cycle.

Figure 9:
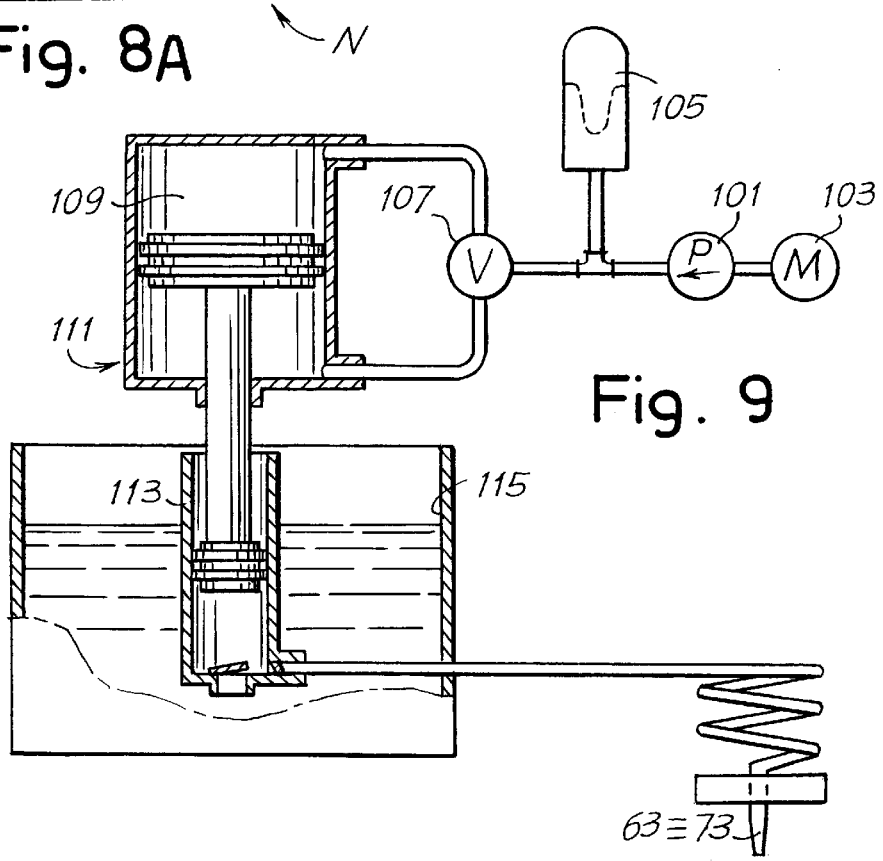
FIG. 9 shows a hydraulic diagram of the arrangements for supplying the water cutting nozzles.

In water cutting systems in which the entire longitudinal cut line is made by a nozzle, extremely high power is required to drive the supply pump. By contrast, in the system according to the invention the installed power can be reduced by around two orders of magnitude because the nozzles are only used in the transitional phase of job changes. During this phase the pressurized water nozzles are operated for about one second, whereas a long period of at least around ten seconds lapses between one change of job and the next. It is therefore possible to adopt a hydraulic layout such as that illustrated in FIG. 9. A pump 101 driven by a low-power motor 103 (typically 8–10 kW) feeds a fluid into an accumulator 105. The accumulator 105 is pressurized by the pump 101 while a job is being processed, that is when the nozzles 63 and 73 are not operating. When the job is to be changed, a valve 107 connects the accumulator 105 to the upper chamber 109 of a pressure multiplier 111. The latter is connected to a cylinder-and-piston system 113 which sends the water at high pressure, taken from a tank 115, to the nozzles 63 and 73.

In view of the comparatively long periods during which the nozzles 63 and 73 are inoperative and the short periods during which they are running, the low-power pump 101 in combination with the accumulator 105 are sufficient to guarantee the requisite output of water to the nozzles at an approximately constant pressure of 3400 bar.

Figure 1:
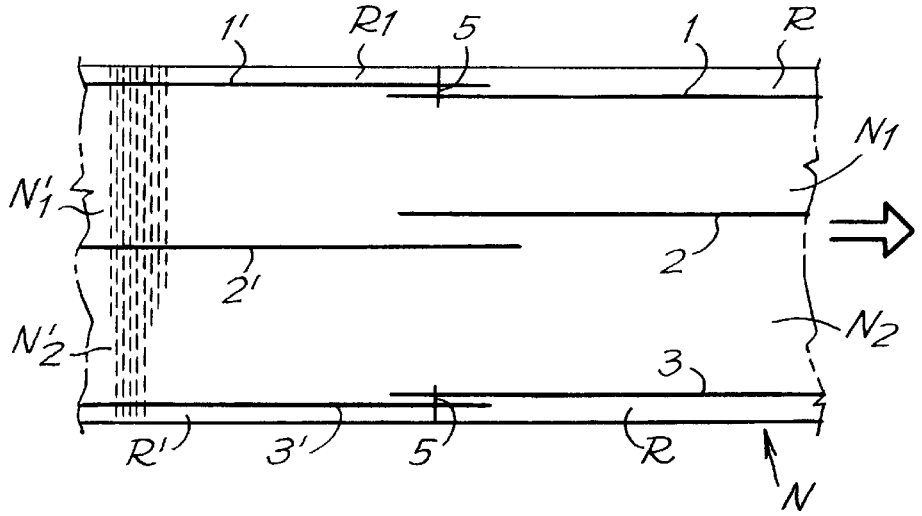
FIGS. 1 through 3, already described, schematically show cutting systems of the prior art.
Figure 2:
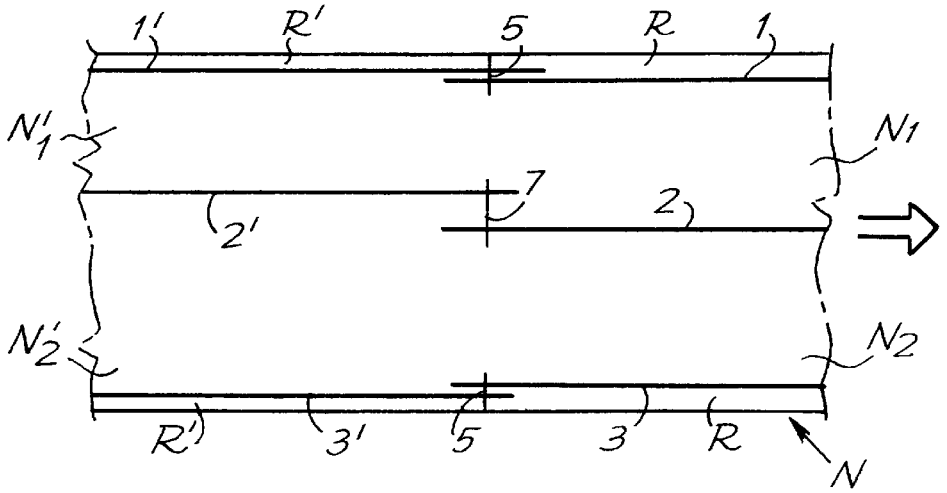

When it is not wished or required that the edge trim R be continuous, the system can be provided with an auxiliary cutting means for joining the intermediate longitudinal lines only. Where the system is constructed (as in the example illustrated) with auxiliary water cutting members, this means that it is possible to provide one or more intermediate nozzles 73 only for joining up their intermediate longitudinal cut lines such as the lines 2, 2' (FIG. 7) by means of a curved cut line 8, while the trims can be cut through transversely by, for example, a conventional auxiliary cutter or by nozzles which make the transverse severing cut, as in FIGS. 1 through 3. This method also still provides the advantages described above relating to the joining up of the intermediate cut lines.

It will be understood that the drawing shows only an example purely by way of a practical demonstration of the invention, it being possible for said invention to be altered as regards shapes and arrangements without thereby departing from the scope of the concept underlying the invention. The presence of any reference numerals in the accompanying claims is purely in order to facilitate the reading of the claims with reference to the description and to the drawing, and does not limit the scope of protection represented by the claims.

I claim:

1. A system for cutting and creasing an indefinite weblike material for processing successive jobs, comprising:

a first set of creasing tools;

a second set of creasing tools;

a first set of cutting tools for dividing said weblike material into a first set of endless strips;

a second set of cutting tools for dividing said weblike material into a second set of endless strips;

positioning means for positioning said cutting and creasing tools;

said first set of cutting tools and said second set of cutting tools each including a pair of cutting tools for generating lateral longitudinal trim cutting lines which generate a longitudinal trim on each side of said weblike material; and a first auxiliary cutting member positioned on each side of the weblike material for making cuts not parallel with the direction of advance of the weblike material for trims along edges of the weblike material;

wherein each first auxiliary cutting member makes a joining cut between the longitudinal trim cutting lines produced by cutting tools of said first set of cutting tools and the longitudinal trim cutting lines produced by the cutting tools of said second set, without transversely severing the trims.

2. The system as claimed in claim 1, operating on at least two levels, comprising at least one second auxiliary cutting member for making a cut not parallel with the direction of advance of the weblike material between two successive longitudinal cut lines at the point where a change of job occurs, which second auxiliary cutting member makes a joining cut between two successive longitudinal cut lines that divide the weblike material into two strips conveyed onto two different levels.

3. The system as claimed in claim 2, in which said at least one second auxiliary cutting member is a pressurized-water nozzle.

4. The system as claimed in claim 2 in which said first auxiliary members and optionally said at least one second auxiliary cutting member are located downstream of the creasing tools and the cutting tools.

5. The system as claimed in claim 2 in which said first auxiliary cutting members and optionally said at least one second auxiliary cutting member are supported by a frame that supports said cutting tools and said creasing tools, said frame being transversely movable in order to follow any transverse wandering of the weblike material.

6. The system as claimed in claim 2, in which said at least one second auxiliary cutting member is mounted on a carriage able to move transversely with respect to the direction of advance of the weblike material.

7. The system as claimed in claim 2, in which said at least one second auxiliary cutting member is vertically movable so as to withdraw from the weblike material in emergencies.

8. System as claimed in claim 1, in which said first auxiliary cutting members are pressurized-water nozzles.

9. The system as claimed in claim 8, comprising a pump for a hydraulic fluid, which feeds a pressure multiplier, while an accumulator of said hydraulic fluid is located between said pump and said pressure multiplier, and said pressure multiplier drives a system that pumps water at high pressure for said auxiliary cutting members.

10. The system as claimed in claim 1, comprising suction nozzles for sucking in the trims, these nozzles being adjustable transversely with respect to the direction of advance of the weblike material, said first auxiliary cutting members being carried by said suction nozzles and being movable transversely together with said suction nozzles.

11. The system as claimed in any one of claim 10, in which means are provided in said suction nozzles to dissipate kinetic energy of a jet of water generated by said first auxiliary cutting members.

12. The system as claimed in claim 1, in which said first and second sets of creasing tools are located adjacent to each other in series and upstream of said first and second sets of cutting tools with respect to the direction of advance of the weblike material, the suction nozzles being located downstream of said sets of cutting tools.

13. The system as claimed in claim 1, wherein said first auxiliary cutting members are able to move toward and away from the weblike material.

14. A method for cutting and creasing a weblike material of indefinite length for processing successive jobs, comprising the following stages:

making a series of longitudinal cut lines for a first job and a series of longitudinal cut lines for a subsequent job wherein the series of longitudinal cut lines for the first job are not aligned with the series of longitudinal cut lines for the subsequent job, and making a series of longitudinal crease lines on said weblike material, which cut lines include defining a longitudinal trim along each side edge of said weblike material for each of the first job and the subsequent job; and when the first job has been finished and the subsequent job is to be begun, changing the position of the cut lines and the crease lines, and producing first auxiliary cuts that are not parallel with the direction of advance of the weblike material along each trim, wherein said first auxiliary cuts that are not parallel with the direction of advance of the weblike material connect a trim of the first job with a trim of the subsequent job without severing said trim.

15. A method as claimed in claim 14, in which the weblike material is divided by a longitudinal cut line into at least two indefinite strips conveyed onto two separate levels; when the first job has been finished and the subsequent job is to be begun, said longitudinal cut line that divides said two strips is moved sideways; and a line of the first job is connected to a line of the subsequent job by a second auxiliary cut not parallel with the direction of advance of the weblike material.

16. A method as claimed in claim 14, in which cutting means are provided to make said series of longitudinal cut lines of the first job and the subsequent job in said weblike material, and auxiliary cutting members are provided to make said first and second auxiliary cuts that are not parallel with the direction of advance of the weblike material.

17. The method as claimed in claim 16, in which said auxiliary cutting members are lined up with a respective longitudinal cut line and activated before a job change-over.

18. The method as claimed in claim 14, in which said first and second auxiliary cuts that are not parallel with the direction of advance of the weblike material are made by pressurized-water nozzles.

19. A system for cutting and creasing an indefinite weblike material, operating on two levels, for processing successive jobs, comprising:

a first set of creasing tools;

a second set of creasing tools;

a first set of cutting tools for dividing said weblike material into a first set of endless strips;

a second set of cutting tools for dividing said weblike material into a second set of endless strips;

positioning means for positioning said cutting and creasing tools;

said first set of cutting tools and said second set of cutting tools each including a pair of cutting tools for generating lateral longitudinal trim cutting lines which generate a longitudinal trim on each side of said weblike material: and a first auxiliary cutting member positioned on each side of the weblike material for making cuts not parallel with the direction of advance of the weblike material for trims along edges of the weblike material; and at least one second auxiliary cutting means for making a cut not parallel with the direction of advance of the weblike material between two successive longitudinal cut lines at a point where a change of job occurs wherein said at least one second auxiliary cutting means makes a joining cut between two successive longitudinal cut lines that divide the weblike material into two strips conveyed onto two different levels, and wherein each first auxiliary cutting member makes a joining cut between the longitudinal trim cutting lines produced by cutting tools of said first set of cutting tools and the longitudinal trim cutting lines produced by the cutting tools of said second set, without severing the trims transversely where a change of job occurs.

20. A system for cutting and creasing an indefinite weblike material for processing successive jobs, comprising:

a first set of creasing tools;

a second set of creasing tools;

a first set of cutting tools for dividing said weblike material into a first set of endless strips;

a second set of cutting tools for dividing said weblike material into a second set of endless strips;

positioning means for positioning said cutting and creasing tools;

said first set of cutting tools and said second set of cutting tools each including a pair of cutting tools for generating lateral longitudinal trim cutting lines which generate a longitudinal trim on each side of said weblike material; and a first auxiliary cutting member positioned on each side of the weblike material for making cuts not parallel with the direction of advance of the weblike material for trims along edges of the weblike material;

wherein each first auxiliary cutting member makes a joining cut between the longitudinal trim cutting lines produced by cutting tools of said first set of cutting tools and the longitudinal trim cutting lines produced by the cutting tools of said second set, without transversely severing the trims and to provide a continuous trim, and wherein suction nozzles for sucking in continuous trims are provided and these nozzles are adjustable transversely with respect to the direction of advance of the weblike material, said first auxiliary cutting members being carried by said suction nozzles and being movable transversely together with said suction nozzles.

21. A method for cutting and creasing a weblike material of indefinite length for processing successive jobs, comprising the following stages:

making a series of longitudinal cut lines for a first job and a series of longitudinal cut lines for a subsequent job wherein the series of longitudinal cut lines for the first job are not aligned with the series of longitudinal cut lines for the subsequent job, and making a series of longitudinal crease lines on said weblike material, which cut lines include defining a longitudinal trim along each side edge of said like weblike material for each of the first job and the subsequent job; and when the first job has been finished, and the subsequent job is to be begun, changing the position of the cut lines and the crease lines, and producing first auxiliary cuts that are not parallel with the direction of advance of the weblike material along each trim, wherein said first auxiliary cuts that are not parallel with the direction of advance of the weblike material connect a trim of the first job with a trim of the subsequent job without severing said trim and to provide a continuous trim, and wherein suction nozzles for sucking in continuous trims are provided and these nozzles are adjustable transversely with respect to the direction of advance of the weblike material, said first auxiliary cutting members being carried by said suction nozzles and being movable transversely together with said suction nozzles.

* * * * *